United States Patent [19]

Butter et al.

[11] Patent Number: 4,768,756

[45] Date of Patent: Sep. 6, 1988

[54] CONVERTER FOR PREPARING STEEL AND A GAS SUPPLY DEVICE FOR SUCH A CONVERTER

[75] Inventors: Johannes A. M. Butter, Uitgeest; Jan S. De Vries, Ursem, both of Netherlands

[73] Assignee: Hoogovens Groep B.V., IJmuiden, Netherlands

[21] Appl. No.: 21,503

[22] Filed: Mar. 4, 1987

[30] Foreign Application Priority Data

Mar. 10, 1986 [NL] Netherlands ..... 8600608

[51] Int. Cl.[4] ..... C21C 5/48

[52] U.S. Cl. ..... 266/218; 266/266; 266/283

[58] Field of Search ..... 266/218, 220, 265, 270, 266/283, 266, 224

[56] References Cited

U.S. PATENT DOCUMENTS 4,238,121 12/1980 Harita et al. ..... 266/283
4,413,815 11/1983 Duhomez et al. ..... 266/266
4,565,355 1/1986 Jilek et al. ..... 266/224

FOREIGN PATENT DOCUMENTS 139311 5/1985 European Pat. Off. .

*Primary Examiner*—L. Dewayne Rutledge
*Assistant Examiner*—Robert L. McDowell
*Attorney, Agent, or Firm*—Stevens, Davis, Miller & Mosher

[57] ABSTRACT

A converter for preparing steel having a refractory lining including a wear lining is provided at its bottom with a plurality of gas supply devices for supply of stirring gas to the molten bath in the converter. Each gas supply device has a generally vertical flat panel which comprises at least two flat metal plates joined together to provide a plurality of gas passages between them. The plates are mounted between bricks of the wear lining. To prevent the plates bulging apart, which causes the gas passages to be blocked by steel the plates are connected to each other between their edges at a plurality of locations distributed over the whole of the plate faces in a manner so as to resist the pressure of the gas in the passages. The bricks of the wear lining adjacent the gas supply device are modified in dimensions to accommodate the gas supply device and/or modified in quality compared with the neighbouring bricks.

32 Claims, 4 Drawing Sheets

VI
5
6

7
9
8

6
6
5
10

7
9
8

III
6
5
10
11

12
6
2a
XI
17
17a 12
6
2a
XII
18
18a 12
16
16a
6

12
17
17a
2a
6

6
15
10
14
11
13

15
6
10
11
14
13

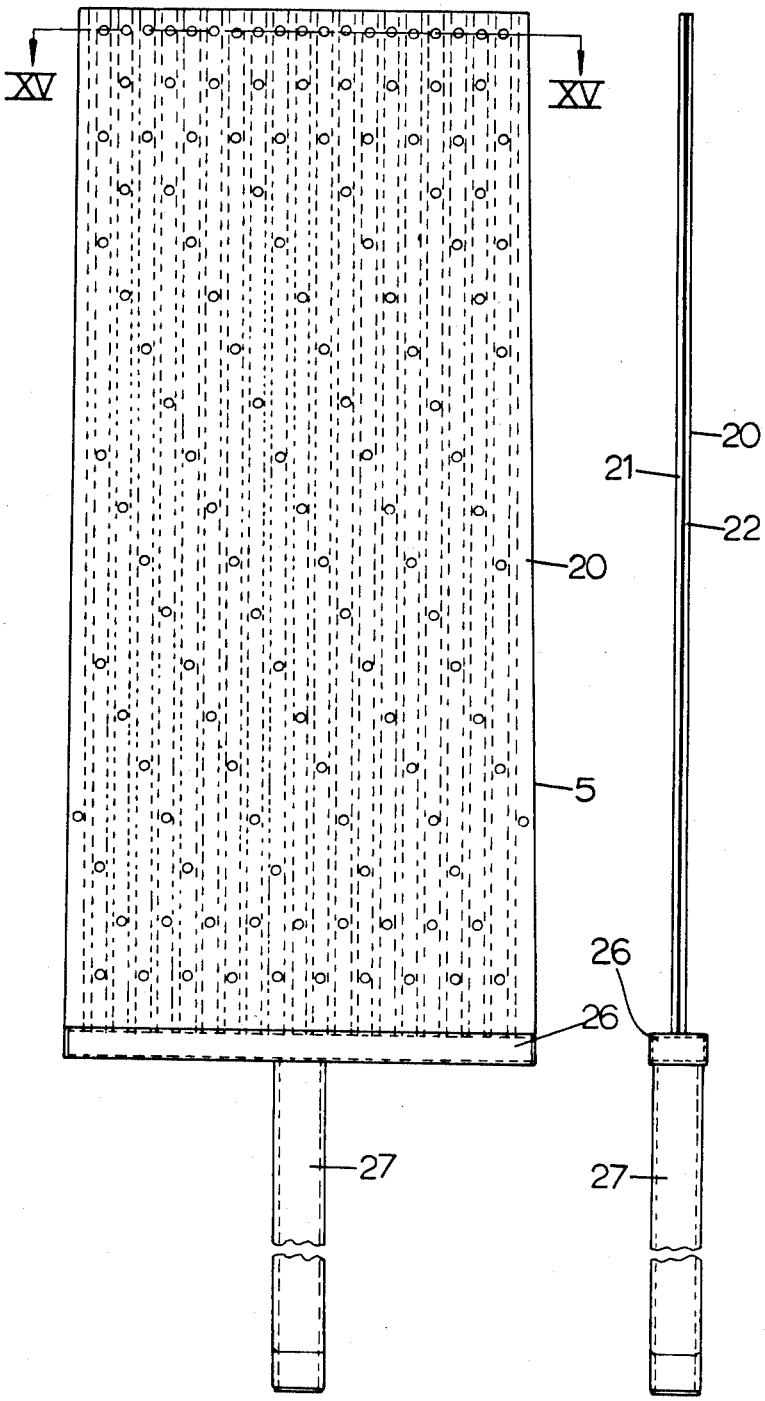
fig. 13
fig. 14
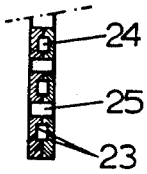
fig. 15

CONVERTER FOR PREPARING STEEL AND A GAS SUPPLY DEVICE FOR SUCH A CONVERTER

BACKGROUND OF THE INVENTION

1. Field of the Invention

The invention relates to a converter for preparing steel, having a refractory lining including a wear lining of refractory bricks, the wear lining being provided at the bottom of the converter with a plurality of gas supply devices for supply of stirring gas to the molten bath in the converter. The invention also relates to the gas supply devices used in the wearing lining of such a converter. These gas supply devices are worn away with the wearing lining. The gas supply devices form scavenging points.

2. Description of the Prior Art

A converter as described above is known and used in practice. During the preparation of the steel in such a converter, oxygen is blown onto the bath by an oxygen lance from above, while a non-oxidising gas such as argon or nitrogen is also fed into the bath through the gas supply devices in the bottom of the converter. The purpose of this is to bring about an extra mixing of the bath, as a result of which metallurgical advantages are gained. It is therefore important that as far as possible, the gas supply devices remain operational during a campaign of the converter. At the end of a campaign, the wear lining is replaced.

For the gas supply devices so-called gas-permeable wall elements have been used, of a type such as for example is shown in EP-A-No.79655, in the name of the assignees of the present applicants. Gas-permeable wall elements of this type have a metal box structure in the shape of a lining brick, the bottom of which is connected to a gas supply. The box structure is fitted with a gas-permeable refractory lining. FIG. 1 of the accompanying drawings illustrate such a device.

One problem with this type of gas-permeable wall element is that its rate of wear, and that of the wear lining round about it, during a campaign is faster than the wear of the other parts of the wear lining in the bottom of the converter. Thus, the wear of the gas-permeable refractory lining of the gas-permeable wall element progresses ahead of the wear of the wear lining. In addition the wear lining near the gas-permeable wall elements is attacked faster than the wear lining at a greater distance from the gas-permeable wall elements.

Another problem with this type of gas-permeable wall element is that one or more of the elements becomes prematurely unusable during the campaign as a result of blockage because the steel from the converter penetrates against the gas flow into the gas-permeable channels of the gas-permeable wall element. Experience is that a wall element once blocked remains blocked upon further wear.

EP-A-No.155255 discloses a gas supply device of a panel shape formed by two metal plates which are joined together at opposite side edges by welding and are held apart by spacers located between them which form a number of parallel gas flow passages extending upwardly of the panel between the plates from a gas distribution box at the bottom of the panel. The panel is located between bricks of the wear lining with the distribution box in the permanent lining. The spacers are intended to prevent crushing of the plates together during heating up of the converter, but cannot prevent bulging apart of the plates by the pressure of the gas between the plates. Such bulging may enlarge the gap between the plates to allow molten steel to enter, leading to blockage of the gas supply device.

The panels of EP-A-No.155255 are located in transverse joints of the wear lining, i.e. joints transverse to the direction of the courses of bricks as seen in plan view. This means that the bricks adjacent the panel do not need to be modified to accommodate the panel, but also that the length of the panel in this transverse direction is limited to the transverse dimension of the course. This restricts the gas-flow capacity of each panel. To enable proper control of the gas flow through each panel, the panels have individual gas supply lines. All the supply lines must pass away from the converter via the pivoting trunnions of the converter. It is therefore of importance to minimise the number of gas supply devices.

SUMMARY OF THE INVENTION

The object of the invention is to provide a converter in which the wear of the gas supply device and the wear lining around it occurs at substantially the same rate as the wear of the other parts of the wear lining and in which the risk of blockage of the gas supply device is reduced.

Another object is to provide a gas supply device which can be of large gas flow capacity and has a low tendency to become blocked, thereby permitting reduction in the number of gas supply devices used in a converter.

According to the present invention, there is provided a converter as described in the opening paragraph above, in which each gas supply device has a generally vertical panel which comprises at least two flat metal plates joined together to provide a plurality of gas passages between them, the plates being mounted in the wear lining. This converter is characterised in that the said plates are connected to each other between their edges at a plurality of locations distributed over the whole of the plate faces in a manner so as to resist bulging apart of the plates under the pressure of the gas in the said passages and in that the bricks of the wear lining adjacent the gas supply device are modified in dimensions to accommodate the gas supply device and/or modified in quality compared with the neighbouring bricks.

The invention is based on the realisation that the walls of the metal box of the known type of gas-permeable wall elements or the plates of the panel type of gas supply device described above are liable to bulge as a result of the pressure of the gas which is passed through the gas supply device into the bath. The deformation and forces during bulging are quite appreciable.

For example, in a two-brick gas-permeable wall element of the known type with a mean gas pressure of 2 atmospheres over-pressure the metal wall can bulge at least 13 mm. The necessary counter-force from the wear lining to counteract the bulging is 44 kN. When the gas-permeable wall element is blocked, there is a pressure of 10 atmospheres over-pressure inside the metal box. The bulging can then be 46 mm. The necessary counter-pressure is 220 kN.

The actual bulging occurring depends on the space present in the wear lining surrounding the gas permeable wall element. In practice there is always some space present in the wear lining, so that usually the bulging only occurs in part.

The consequence is that unexpectedly large gaps occur in the gas-permeable wall element, for example between the metal box and its refractory lining, into which steel can penetrate and cause wear in the refractory lining and/or blockage of the gas-permeable wall element. Due to the removal, by the pressure exerted by the gas-permeable wall element, of the clearance in the wear lining around the gas-permeable wall element, in some places gaps occur in the wear lining. At these gaps, the wear lining is attacked. In addition, the refractory lining of the gas-permeable wall element and the wear lining around it undergo accelerated wear because of a greater heat load as a result of cooling by the gas being fed in.

In the invention, metal plates of the gas supply panel arranged opposite each other are secured to each other, with a small gap between them or in contact with channels in one or both plates forming the gas passages, in such a manner that bulging is wholly or largely prevented. As a result no unexpectedly large gaps occur in and around the gas supply devices. Consequently wear of the lining and blockage of the gas flow is reduced. In addition, the refractory lining present in the known gas-permeable wall element discussed above, which is so sensitive to wear, is eliminated.

The stresses in the wear lining near the gas supply panel as a result of the heat load are reduced by building in smaller bricks around the gas supply panel. In this way uniform, or nearly uniform wear of the wear lining of the bottom of the converter is achieved while blockages of the gas supply panels are wholly or partly prevented.

With the preferred dimensions in the invention (specified below), the hydraulic diameter of each channel through which the gas is fed is such that, at a suitable and convenient gas pressure, no penetration of the steel into the channel takes place. The channel size should be selected such that, depending on the heating capacity of the gas supply panel, the panel is cooled sufficiently by the gas, and the distances between the locations at which the plates are connected together to absorb tension is selected such that no appreciable bulging occurs. In panels with parameters within the ranges mentioned no or virtually no blockage occurs. The panels remain sufficiently cool and flat.

Suitably, the gas supply panel at its lower end is provided with a gas distribution box connected to a gas supply line, which box is located in the wear lining. The gas passages in the panel all open into the distribution box. The advantage of a gas supply line of the gas supply device will be explained below. By including the distribution box in the wear lining, the distribution box does not get jammed if the wear lining is pushed over the permanent refractory lining underneath it when the converter enters into operation at the start of a campaign.

The known gas-permeable wall elements discussed above have a limited gas supply capacity, i.e. each element is suitable for a maximum in the range 10 to 20 tonnes of the contents of the steel converter each. The gas supply of each wall element must be controlled separately and must for this reason be fed separately through the trunnions of the converter. In the present invention a gas supply device of greater flow rate can be obtained; this permits the use of a relatively simple gas supply system.

Preferably, therefore, the gas supply device of the invention extends in the course direction over the width in that direction of at least one brick of the course. This means that the gas supply device can be large, without disturbing the general layout of the bricks.

In one preferred arrangement, as seen in plan view the gas supply device is located in a first course at the joint between that course and an adjacent course, one or more bricks of said first course having reduced thickness in the direction transverse to the course direction compared with neighbouring bricks of the first course in order to accommodate the gas supply device.

In another, preferred arrangement, as seen in plan view the gas supply device is located in a first course at a location between and spaced from the two joints between that course and the adjacent courses, with bricks of narrow thickness compared with neighbouring bricks of the first course arranged at each side of the gas supply device.

In a third preferred arrangement, the gas supply device has two said panels arranged parallel and spaced apart by a distance such that in the wear lining, as seen in plan view, the two panels are located in a first course respectively at the joints between that course and the two adjacent courses, one or more bricks of the course lying between said two panels having reduced thickness in the direction transverse to the course direction compared with neighbouring bricks of the first course in order to accommodate the panels.

The preferred designs just described can all have a large gas supply capacity and can easily be built into the wear lining of the bottom of a converter. With such gas supply devices, which have larger gas flow capacities than prior art devices used in practice and are also less liable to blockage, the number of gas supply devices in a converter can be reduced, or the same number of gas supply devices can serve a larger converter. With the invention, it is possible to use no more than six gas supply devices in a converter having a practical capacity of at least 120 tonnes. Indeed six gas supply devices may be sufficient in a converter of 300 tonnes capacity.

Preferably, the wear lining in the vicinity of the gas supply device is at least partly of smaller bricks than the refractory bricks of standard dimensions of which the wear lining is made elsewhere.

Preferably here the wear lining near the gas supply device is built up of bricks with a width which is half of the width of standard refractory bricks from which the wear lining is made elsewhere. This can mean that the wear lining near the scavenging element wears just as quickly as the wear lining at other points.

The invention also extends to the gas supply panel described above.

BRIEF DESCRIPTION OF THE DRAWINGS

Embodiments of the invention are described below by way of non-limitative example, with reference to the accompanying drawings, in which:

FIG. 13 is a side view of another gas supply panel, similar to that of FIG. 2, for a converter in accordance with the invention.

FIG. 14 is a view onto one side edge of the panel of FIG. 13.

FIG. 15 is a cross section, on a larger scale, on A—A in FIG. 13.

FIG. 1 shows by way of example the situation which occurs with a gas-permeable wall element 1 of the size of two bricks 2 of the wear lining of normal dimensions (such normal dimensions are a thickness of about 100 mm and a width of about 150 mm). In relation to bricks, we here call their dimension in the direction of the courses of the lining "width" and the direction transverse thereto "thickness". The wall element 1 is of the type with a metal box 3 having a refractory gas-permeable lining 4. In a typical case of the start of a blockage of the gas permeable wall element and an expansion space in the wear lining of 14 mm the expansion space in the wear lining is eliminated by the force caused by the gas pressure of 140 kN. Thus the metal box bulges. A gap of 7 mm occurs between the wall of the metal box 1 and the refractory lining 4 of the gas-permeable wall element as shown in FIG. 1, as a result of which the molten steel can penetrate into the gas-permeable wall element and cause permanent blockage.

Figure 1:
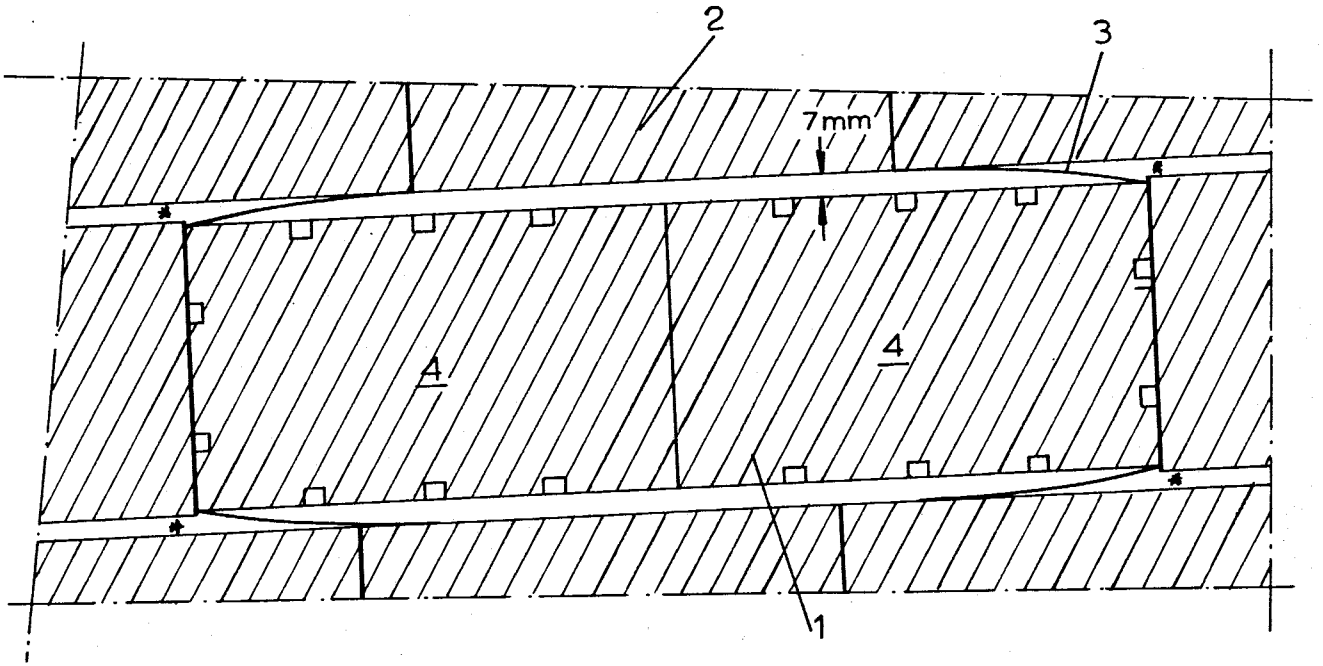
fig. 1 PRIOR ART
FIG. 1 is a horizontal cross-sectional view of the known gas-permeable wall element discussed above.

In addition, as a result of the elimination of the expansion space in the wear lining, not only between the metal box and the refractory lining, but also at other points in the wear lining gaps occur such as for example at the points marked by a * in FIG. 1. At these open joints in the wear lining the wear lining is attacked, as a result of which the wear is greater there than at points located further from the wall element.

Figures 2, 3, 4, 5, 6:
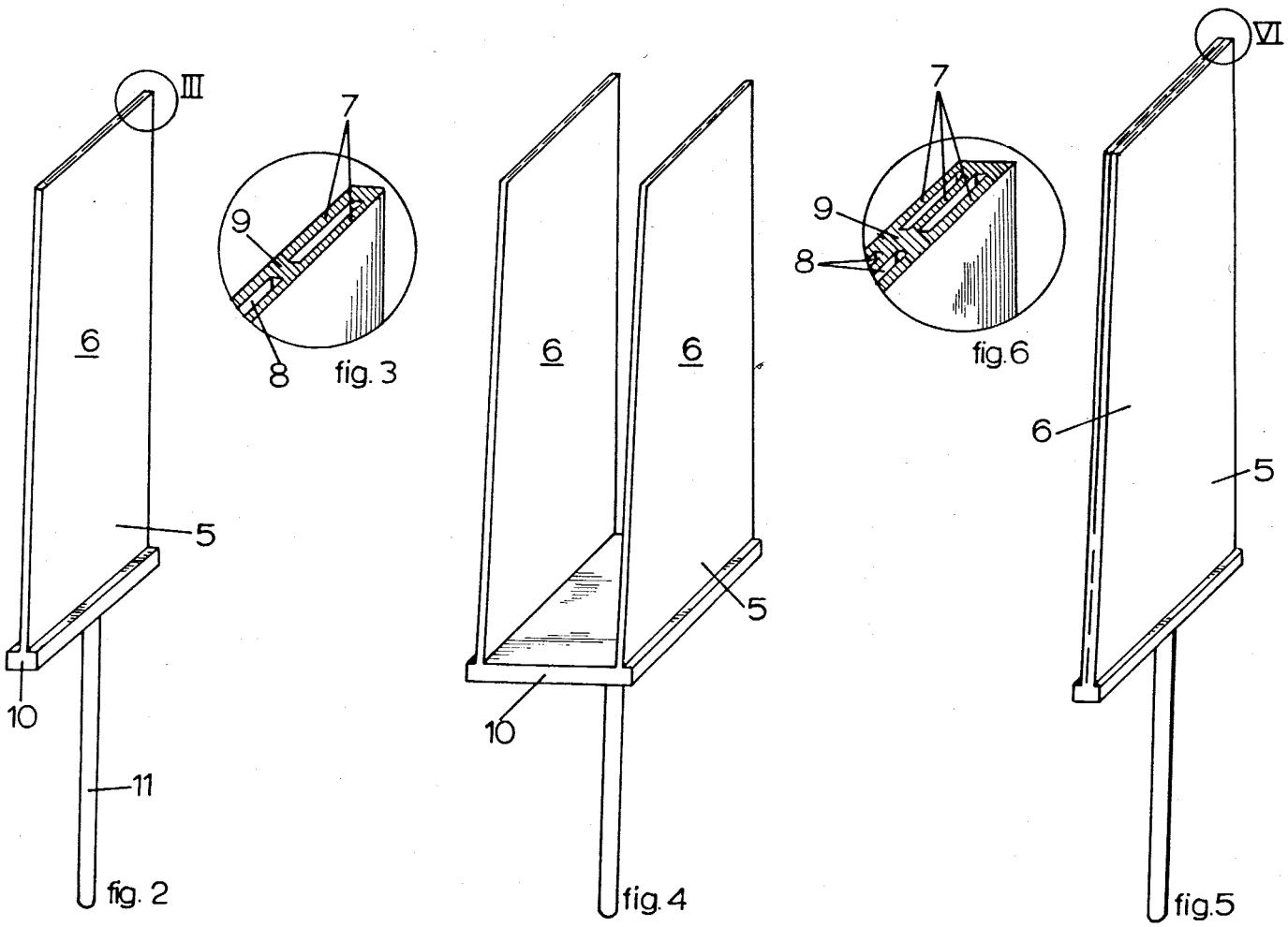
FIG. 2 shows in perspective one gas supply device for a converter in accordance with the invention.
FIG. 3 shows the detail III of FIG. 2 on a larger scale.
FIG. 4 shows a second embodiment of a gas supply device for a converter in accordance with the invention.
FIG. 5 shows a third embodiment of a gas supply device for the converter in accordance with the invention.
FIG. 6 shows the detail VI in FIG. 5 on a larger scale.

The gas supply device 5 of the invention shown in FIG. 2 is flat and consists of a flat panel 6, which, see FIG. 3, consists of two flat steel plates 7 which are connected together with a narrow gas passage 8 between them at many points 9, where a force tending to urge the plates apart can be absorbed, as a result of which the plates cannot or virtually cannot bulge under the effect of gas pressure. The connection of the plates can for example take place by welding, in particular spot welding or seam welding.

In this and the other embodiments described below, the plates 7 of the panel are firmly connected together at points distributed all over their faces. In the vertical direction, these points may be continuously joined to form connection lines (seams).

The gas supply panel 6 has at its lower end a distribution box 10 connected to a gas supply line 11. The gas fed through the supply line 11 is distributed through the distribution box 10 across the lower end of the panel and through the passages 8 into the bath.

FIG. 4 shows an embodiment of the gas supply device with two parallel, spaced panels 6, as described above and a common distribution box 10.

FIG. 5 shows a gas supply device 5 with a panel 6, which as seen in FIG. 6, consists of three parallel flat plates 7 which are connected together as described, with narrow channels 8 between them, at many points 9, at which a tensile force between the plates can be absorbed, as a result of which the plates cannot or virtually cannot bulge under the influence of gas pressure.

Figures 7, 8, 9, 10, 11, 12:
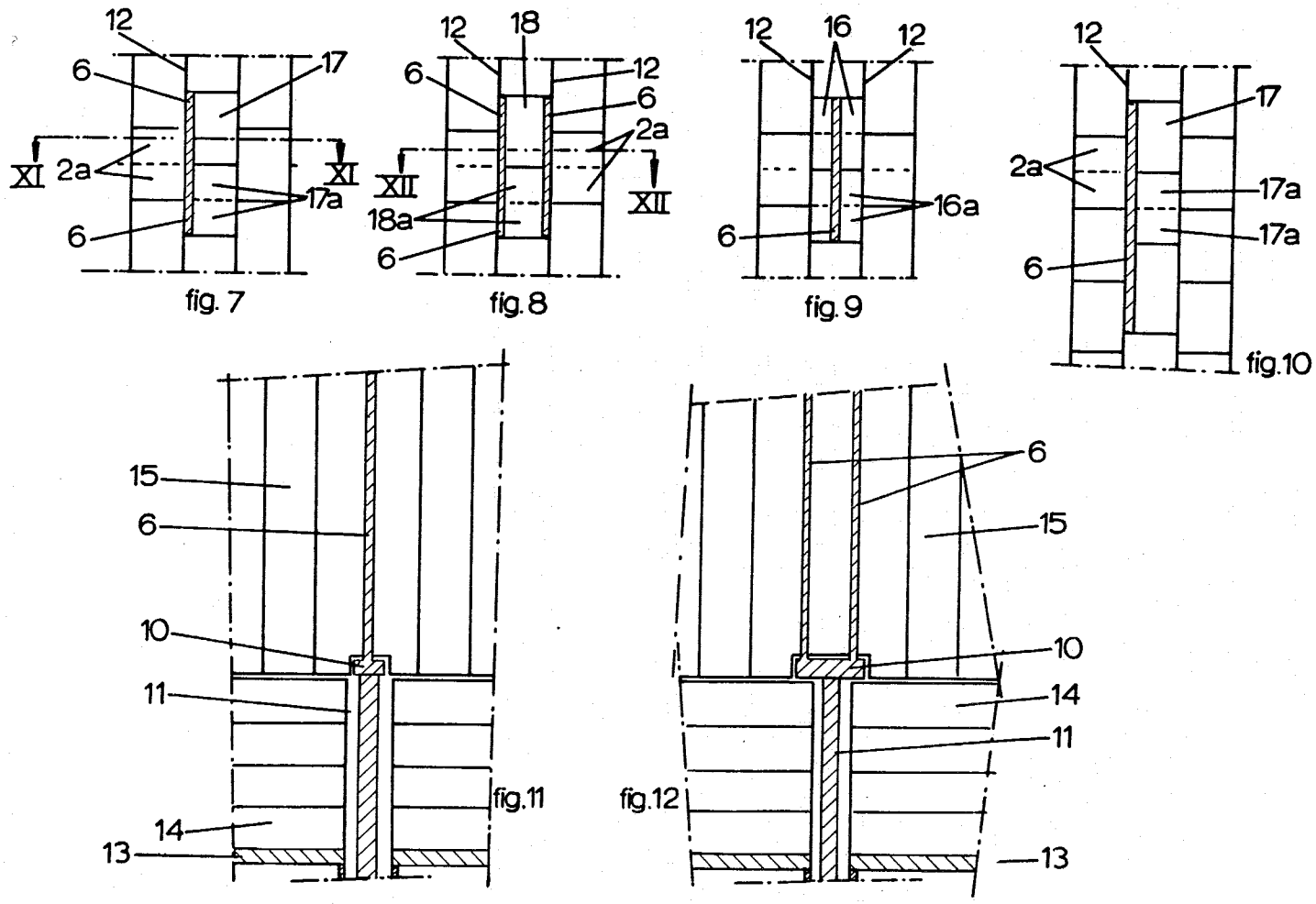
FIGS. 7, 8, 9 and 10 are plan views of parts of the wear linings of the bottoms of converters in accordance with the invention in various embodiments illustrating various arrangements of the gas supply devices and the adjacent brickwork.
FIG. 11 is a vertical cross section on XI—XI in FIG. 7.
FIG. 12 is a vertical cross section on XII—XII in FIG. 8.

In FIG. 7 and in FIG. 10 a gas supply device of the invention with one panel 6, for example the device of FIG. 2 or 5, is built in at a longitudinal seam 12 of the wear lining i.e. at the joint between two courses of the bricks of the wear lining. The panel is parallel to this joint direction. The panels in each case extend over two or more bricks of the wear lining of normal dimensions in the course direction.

In FIG. 8 a gas supply device with two parallel panels 6, for example the device of FIG. 4 is built in at two joints 12 between courses of the wear lining with the panels parallel to the joint direction. In FIG. 9 a gas supply device with one panel 6 is located between and spaced from two joints 12 between courses of the wear lining. The panel is again parallel to the course direction.

In FIGS. 7 to 10 it can be seen that the panels 6 are thin with respect to a refractory brick of the wear lining. The thickness of the panels 6 is in the range of 2 to 15 mm, but preferably from 2 to 10 mm. The distance between two adjacent points where the plates of the panel are connected, i.e where a tensile force between the plates can be absorbed, is appreciably smaller than the width dimension of a refractory brick of the wear lining of standard dimensions and is not greater than 75 mm, and is more preferably not greater than 50 mm. The width of the gas passages between the metal plates of the panel 6 is in the range of 1 to 10 mm, and more preferably from 1 to 5 mm.

FIGS. 11 and 12 show the armour 13 of the bottom of the converter, the permanent lining 14 and the wear lining 15. It can be seen that the panels 5 are built in vertically and that the distribution box 10 is located in the wear lining. Since the converter bottom may be somewhat rounded, the panels 6 may not be exactly vertical. The drawings of course illustrate the upright position of the converter.

In the embodiments shown in FIGS. 7,8,9 and 10 the brickwork forming part of the wear linirg adjacent to the scavenging element is modified to accommodate the panels 6. In FIGS. 7 and 10 the thickness of the bricks 17 alongside the panel 6 is less than that of other bricks of the same course by an amount equal to the thickness of the panel. Similar adjustments are also shown in FIGS. 8 and 9. In FIG. 8 the thickness of the bricks 18 between the panels 6 is reduced by an amount equal to the sum of the thicknesses of the two scavenging panels 6. In FIG. 9 the thickness of the split bricks 16 on each side of the panel is in total reduced by an amount equal to the thickness of the panel 6 compared with the standard thickness of the bricks of the course.

Preferably the wear lining in the vicinity of the gas supply devices is made up from smaller bricks than the refractory bricks of standard dimensions from which the wear lining is generally built. Particularly, it is preferred that at least some of the bricks adjacent the panels 6 are halved in their width compared with the standard width in FIGS. 7 and 10 for example, bricks 2*a*, 17*a* of half width are indicated by broken lines; similarly in FIG. 8 bricks 2*a* and 18*a* and in FIG. 9 bricks 16*a* are shown. By this measure, the stresses produced by the thermal load on the bricks due to cooling by the gas which is passed through the gas supply device are reduced; as a result of this the bricks wear less.

The bricks of the wear lining adjacent the gas supply device may also be modified in quality compared with neighbouring bricks of the wear lining. In practice, this preferably means using bricks of material of higher quality adjacent the gas supply devices. Preferred bricks of higher quality are magnesia-carbon bricks e.g. as described in EP-A-No.139311, in the name of the assignees of the present applicants.

FIGS. 13, 14 and 15 show a gas supply device 5 which is for use in a converter in the same manner as the embodiments described above. The device has a flat panel 20 consisting of the steel plates 21,22 which are in face-to-face contact and have in their contacting faces grooves 23 extending in the length direction (vertical direction) of the panel from end to end of the panel. The grooves 23 in one plate are opposite the grooves 23 of the other plate so that gas passages 24 are formed between the plates. The gas passages 24 may be interconnected in the panel 20 by cross-passages (not shown). The plates 21,22 are secured together by a large number of welded-in steel pins 25 located tightly in apertures bored through the plates. The ends of the pins 25 are flush with the exterior faces of the plates, and after welding these faces are grooved to render them flat.

The connecting pins 25 are numerous and distributed all over the panel in an array which extends both across and along the panel. To give some examples of dimensions, the spacing of the 19 horizontal rows shown in FIG. 13 is 35 mm, while the spacing in the horizontal direction is 15 mn in the topmost row and 30 mm or 60 mm in other rows. No pin is more than 50 mm from its closest neighbour or neighbours. The plates 20, 21 are each 4 mm thick and the grooves 23 each 2 mm deep.

At the lower end of the panel 20 there is a gas distribution box 26 extending the full width of the panel, into which the passages 24 open. The box 26 is connected to a gas supply pipe 27.

We claim:

1. Converter for preparing steel, having a refractory lining including a wear lining of refractory bricks, the wear lining extending over at least the converter bottom; and a plurality of gas supply devices for supply, during operation of the converter, of stirring gas to the molten bath in the converter, the gas supply devices being spaced apart in the converter bottom, each said gas supply device being of generally vertical flat panel form and comprising at least two generally flat plates arranged face-to-face to provide a plurality of passages between them for said gas, the plates being mounted between bricks of the wear lining and being connected to each other at a plurality of locations distributed over the whole of their faces in a manner so as to resist bulging apart of the plates under the pressure of the gas in said passages;

wherein the bricks of the wear lining adjacent each gas supply device are at least one of (a) modified in outer dimensions compared with neighbouring bricks to accommodate the gas supply device and (b) modified in quality compared with neighbouring bricks.

2. Converter according to claim 1 wherein, as seen in plan view, the gas supply device extends parallel to the direction of the courses of the adjacent bricks of the wear lining, and at least one brick adjacent the device has reduced thickness compared to neighbouring bricks of the same course.

3. Converter according to claim 2, wherein the gas supply device extends in the course direction over the width in that direction of at least one brick of the course.

4. Converter according to claim 3 wherein as seen in plan view the gas suppply device is located in a first course at the joint between that course and an adjacent course, one of more bricks of said first course having reduced thickness in the direction transverse to the course direction compared with neighboring bricks of the first course in order to accommodate the gas supply device.

5. Converter according to claim 3 wherein as seen in plan view the gas supply device is located in a first course at a location between and spaced from the two joints between that course and the adjacent courses, there being bricks of narrow thickness compared with neighboring bricks of the first course arranged at each side of the gas supply device.

6. Converter according to claim 3 wherein the gas supply device has two said panels arranged parallel and spaced apart by a distance such that in the wear lining, as seen in plan view, the two panels are located in a first course respectively at the joints between that course and the two adjacent courses, one or more bricks of the course lying between said two panels having reduced thickness in the direction transverse to the course direction compared with neighboring bricks of the first course in order to accommodate the panels.

7. Converter according to claim 2 wherein as seen in plan view the gas supply device is located in a first course at the joint between that course and an adjacent course, one or more bricks of said first course having reduced thickness in the direction transverse to the course direction compared with neighbouring bricks of the first course in order to accommodate the gas supply device.

8. Converter according to claim 2 wherein as seen in plan view the gas supply device is located in a first course at a location between and spaced from the two joints between that course and the adjacent courses, there being bricks of narrow thickness compared with neighbouring bricks of the first course arranged at each side of the gas supply device.

9. Converter according to claim 2 wherein the gas supply device has two said panels arranged parallel and spaced apart by a distance such that in the wear lining, as seen in plan view, the two panels are located in a first course respectively at the joints between that course and the two adjacent courses, one or more bricks of the course lying between said two panels having reduced thickness in the direction transverse to the course direction compared with neighbouring bricks of the first course in order to accommodate the panels.

10. Converter according to claim 2 wherein at the lower end of said panel there is provided a gas distribution box into which all said gas passages between the plates open for supply of gas into the passages, said distribution box being connected to a gas supply line and being located in the wear lining.

11. Converter according to claim 2 wherein said plates are in face-to-face contact and said gas passages are formed by grooves in at least one of said contacting plates.

12. Converter according to claim 2 which has a capacity of at least 120 tonnes and not more than six of said gas supply devices.

13. Converter according to claim 1 wherein the wear lining adjacent the gas supply device is at least partly formed of bricks smaller than the standard bricks of neighbouring regions.

14. Converter according to claim 13 wherein said smaller bricks have, as seen in plan, a width in the direction of the courses of the bricks which is half the corresponding width of bricks in neighbouring regions.

15. Converter according to claim 14 wherein the bricks adjacent the gas supply device are magnesia-carbon bricks.

16. Converter according to claim 13 wherein the bricks adjacent the gas supply device are magnesia-carbon bricks.

17. Converter according to claim 11 wherein the bricks adjacent the gas supply device are magnesia-carbon bricks.

18. Converter according to claim 1 wherein the thickness of the panel is in the range 2 to 15 mm and the width of the said gas passages in the panel in the thickness direction of the panel is in the range 1 to 10 mm.

19. Converter according to claim 10 wherein the thickness of the panel is in the range 2 to 10 mm and the width of the said gas passages in the panel in the thickness direction of the panel is in the range 1 to 5 mm.

20. Converter according to claim 18 wherein at the lower end of said panel there is provided a gas distribution box into which all said gas passages between the plates open for supply of gas into the passages, said distribution box being connected to a gas supply line and being located in the wear lining.

21. Converter according to claim 1 wherein the distance between each said location of connection of the two plates and the closest neighbouring such location or locations of connection is not more than 75 mm.

22. Converter according to claim 21 wherein the distance between each said location of connection of the two plates and the closest neighbouring such location or locations of connection is not more than 50 mm.

23. Converter according to claim 1 wherein at the lower end of said panel there is provided a gas distribution box into which all said gas passages between the plates open for supply of gas into the passages, said distribution box being connected to a gas supply line and being located in the wear lining.

24. Converter according to claim 1 wherein said plates are connected together at each said location of connection by a pin which extends through apertures in the plates and is welded in place.

25. Converter according to claim 24 wherein said plates are in face-to-face contact and said gas passages are formed by grooves in at least one of said contacting plates.

26. Converter according to claim 24 which has a capacity of at least 120 tonnes and not more than six of said gas supply devices.

27. Converter according to claim 1 wherein said plates are in face-to-face contact and said gas passages are formed by grooves in at least one of said contacting plates.

28. Converter according to claim 1 which has a capacity of at least 120 tonnes and not more than six of said gas supply devices.

29. Gas supply device for a steel converter, to be located in the wear lining of the bottom of the steel converter to conduct gas through the wear lining for stirring the molten bath in the converter, the device having at least one flat panel which comprises at least two flat metal plates joined together with mutually opposed faces and providing a plurality of gas passages between said opposed faces, said plates being connected to each other at a plurality of locations distributed over the whole of said plate faces in a manner so as to resist bulging apart of the plates under the pressure of the gas in the said passages.

30. Gas supply device according to claim 29 wherein said panel has at one end a gas distribution box which extends across the width of the panel and into which said gas passages open.

31. Gas supply device according to claim 30 wherein said plates are connected at each of said plurality of connection locations by a pin which passes through apertures in the plates and is welded in place.

32. Gas supply device according to claim 29 wherein said plates are connected at each of said plurality of connection locations by a pin which passes through apertures in the plates and is welded in place.

* * * * *